US006241414B1

(12) United States Patent
Wien

(10) Patent No.: US 6,241,414 B1
(45) Date of Patent: Jun. 5, 2001

(54) BINDERS WITH FLEXIBLE POCKETS

(75) Inventor: Thomas Wien, Newport Beach, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/360,665

(22) Filed: Jul. 26, 1999

(51) Int. Cl.[7] ..... B42D 5/00; B42F 3/00

(52) U.S. Cl. ..... 402/73; 402/70; 281/20; 281/29; 281/37; 281/45; 283/36

(58) Field of Search ..... 281/20, 29, 37, 281/45; 402/70, 73; 283/36

(56) References Cited

U.S. PATENT DOCUMENTS

| | | | | |
|---|---|---|---|---|
| 156,588 | * | 11/1874 | Mets . | |
| 405,874 | | 6/1889 | Collins . | |
| D. 418,327 | * | 1/2000 | Sullins et al. | D6/406.3 |
| 575,809 | | 1/1897 | O'Riva . | |
| 818,202 | | 4/1906 | Sweet . | |
| 1,848,980 | | 3/1932 | Walker . | |
| 2,088,953 | * | 8/1937 | Greer | 281/31 |
| 2,194,003 | * | 3/1940 | Brooks | 281/3 |
| 2,544,566 | | 3/1951 | Rose . | |
| 2,677,376 | | 5/1954 | Brunner . | |
| 3,565,462 | * | 2/1971 | Gottlieb | 281/3 |
| 3,814,527 | | 6/1974 | Lawes . | |
| 4,004,689 | | 1/1977 | Glasell . | |
| 4,629,349 | | 12/1986 | Pitts . | |
| 4,639,157 | | 1/1987 | Herzfeld . | |
| 4,790,474 | | 12/1988 | Mitsuyama . | |
| 4,824,273 | * | 4/1989 | Silva et al. | 402/79 |
| 4,838,724 | | 6/1989 | Spence, Jr. . | |
| 4,892,333 | | 1/1990 | Krulich . | |
| 4,961,596 | | 10/1990 | Moor . | |
| 4,964,508 | | 10/1990 | Balsley . | |
| 4,986,572 | * | 1/1991 | Kuykendall | 281/15.1 |
| 5,036,973 | * | 8/1991 | Aida | 201/214 |
| 5,183,294 | | 2/1993 | Jukola et al. . | |
| 5,219,437 | | 6/1993 | Moore et al. . | |
| 5,236,226 | * | 8/1993 | Sheffield | 281/48 |
| 5,240,340 | * | 8/1993 | Lynch et al. | 402/79 |
| 5,261,701 | * | 11/1993 | Walters | 281/31 |
| 5,330,279 | * | 7/1994 | Ruble | 402/3 |
| 5,350,249 | * | 9/1994 | Peters | 402/4 |
| 5,370,419 | * | 12/1994 | Takayama | 281/31 |
| 5,380,043 | * | 1/1995 | Schwartz | 281/15.1 |
| 5,494,366 | | 2/1996 | Pell et al. . | |
| 5,671,950 | * | 9/1997 | Hanson | 281/29 |
| 5,676,482 | | 10/1997 | Hawkins . | |
| 5,704,646 | * | 1/1998 | Tzeng | 281/29 |
| 5,711,627 | | 1/1998 | Chapman . | |
| 5,749,666 | | 5/1998 | Yu . | |
| 5,823,574 | * | 10/1998 | Sullins et al. | 281/45 |
| 5,876,143 | * | 3/1999 | Ong | 402/3 |
| 5,911,441 | * | 6/1999 | Yamamoto et al. | 281/15.1 |
| 5,916,280 | * | 6/1999 | Lantz | 281/29 |
| 5,951,189 | * | 9/1999 | Winzen | 402/3 |
| 5,975,578 | * | 11/1999 | Mayer | 281/37 |
| 6,017,062 | * | 1/2000 | White | 281/29 |
| 6,024,508 | * | 2/2000 | Lippeth et al. | 402/73 |

* cited by examiner

*Primary Examiner*—A. L. Wellington
*Assistant Examiner*—Alisa L Thurston
(74) *Attorney, Agent, or Firm*—Oppenheimer Wolff & Donnelly, LLP

(57) ABSTRACT

The present invention discloses a variety of pockets associated with a binder. In one embodiment, a ruler pocket that is formed from a mesh is sewn to the spine of a binder. Another embodiment discloses a mesh pocket formed over a VELCRO flap which is designed to strap the binder closed. There are two VELCRO closures involved with the flap, one VELCRO closer serving to close the pocket, and the other VELCRO pair serving to hold the two binder covers together. Yet another embodiment discloses a pocket inside of the binder where the front side of the pocket is made of fabric, the back side is made of mesh, with a center divider forming two pockets. Each pocket may be securely closed by a VELCRO book and loop system or a zipper mechanism to open and close the pockets.

15 Claims, 3 Drawing Sheets

BINDERS WITH FLEXIBLE POCKETS

BACKGROUND OF THE INVENTION

1. Field of Invention

This invention relates generally to binders with associated flexible pockets.

2. Description of the Related Art

Binders are used to hold a variety of items, such as papers, pencils, cards, and similar objects. The carrying capacity of the binder however is limited to the space between the front and back covers of the binder. Also, once the covers are closed, a user cannot tell if a particular item is inside the binder or not. To verify whether these items are present, the covers must be opened to see if the particular item is inside the binder or not. For example, many users carry credit cards or even key chains in their binders. However, users sometimes forget to check the inside of their binders and leave home without them, and this may mean locking themselves out of their homes or not being able to purchase anything without their credit cards.

Furthermore, carrying accessories inside a binder takes up valuable carrying space within the binder. Indeed, carrying items such as credit cards and key chains inside the binder means less space for other items, such as papers and pens. Also, binders are generally designed to hold papers, but not a ruler, for example. That is, most binders have 12 inches of exterior height but the interior vertical height is slightly less than 12 inches, so that a 12 inch ruler does not quite fit vertically inside the binder. Instead, the ruler is diagonally placed to compensate for the slight extension of the ruler. In other words, the binder lacks an appropriate place to conveniently carry a 12 inch ruler.

Yet another shortcoming with today's binders is that the space between the covers is not economically utilized. That is, once the covers of the binder are closed there is generally a void between the front cover and the papers being held by the three ring holder mechanism. The void exists because the three ring holder mechanism generally protrudes out from the spine or the back cover so that the papers slope down against the back cover, and the negative slope of the papers forms a void or space between the paper and the front cover. Some binders do have interior pockets on the inside of the covers, but these pockets do not take full advantage of the void, because the interior pockets do not bulge or expand to take advantage of the void. That is, the pockets are attached to the cover around all of the edges so that the pockets are held close to the cover and cannot bulge or expand into the void.

Accordingly, there still is a need for a binder that can carry accessories and larger items such as a ruler conveniently without taking up valuable space within the binder, so that a user can tell if the items are being carried by the binder or not; and to provide a configuration that takes advantage of the void left between the cover and the papers held in the three ring binder mechanism.

OBJECT AND SUMMARY OF THE INVENTION

A general object of the present invention is to provide a binder that has at least one pocket, preferably a mesh pocket, for conveniently carrying a ruler and other personal items which can be seen through the carrying pocket so that a user will know whether the item is being carried by the binder or not. Another aspect of the present invention is that it utilizes the void left between the cover and the papers held in the three ring mechanism. These and other objectives are accomplished by providing a front cover; a back cover; a spine coupling the front and back covers along a front fold line and a back fold line, respectively, forming a binder; a ruler pocket having outer edges substantially coextensive with the spine of the binder, wherein the outer edges of the ruler pocket are coupled to the spine, except at one edge to form an opening; wherein the ruler pocket is flexible to readily receive or remove a ruler through the opening of the ruler pocket.

Another objective of the present invention is accomplished by providing a front cover; a back cover; a spine coupling the front and back covers along a front fold line and a back fold line, respectively, forming a binder; wherein the binder has an exterior surface when the binder is in a closed position; and a mesh pocket coupled to the exterior surface of the binder.

Yet another objective of the present invention is accomplished by providing a front cover; a back cover; a spine coupling the front and back covers along a front fold line and a back fold line, respectively, forming a binder; and a plurality of mesh pockets coupled to the binder.

The above described features of the present invention and many other of its attendant advantages will become apparent from a consideration of the following detailed description when considered in conjunction with the accompanying drawings.

BRIEF DESCRIPTION OF THE DRAWINGS

Detailed description of the preferred embodiment of the invention will be made with reference to the accompanying drawings.

DETAILED DESCRIPTION OF THE PREFERRED EMBODIMENTS

Disclosed herein is a detailed description of a best presently known modes of carrying out the invention. This description is not to be taken in a limiting sense, but is made merely for the purpose of illustrating the general principles of the invention. The section titles and overall organization of the present detailed description are for the purpose of convenience only and are not intended to limit the present invention.

Figure 1:
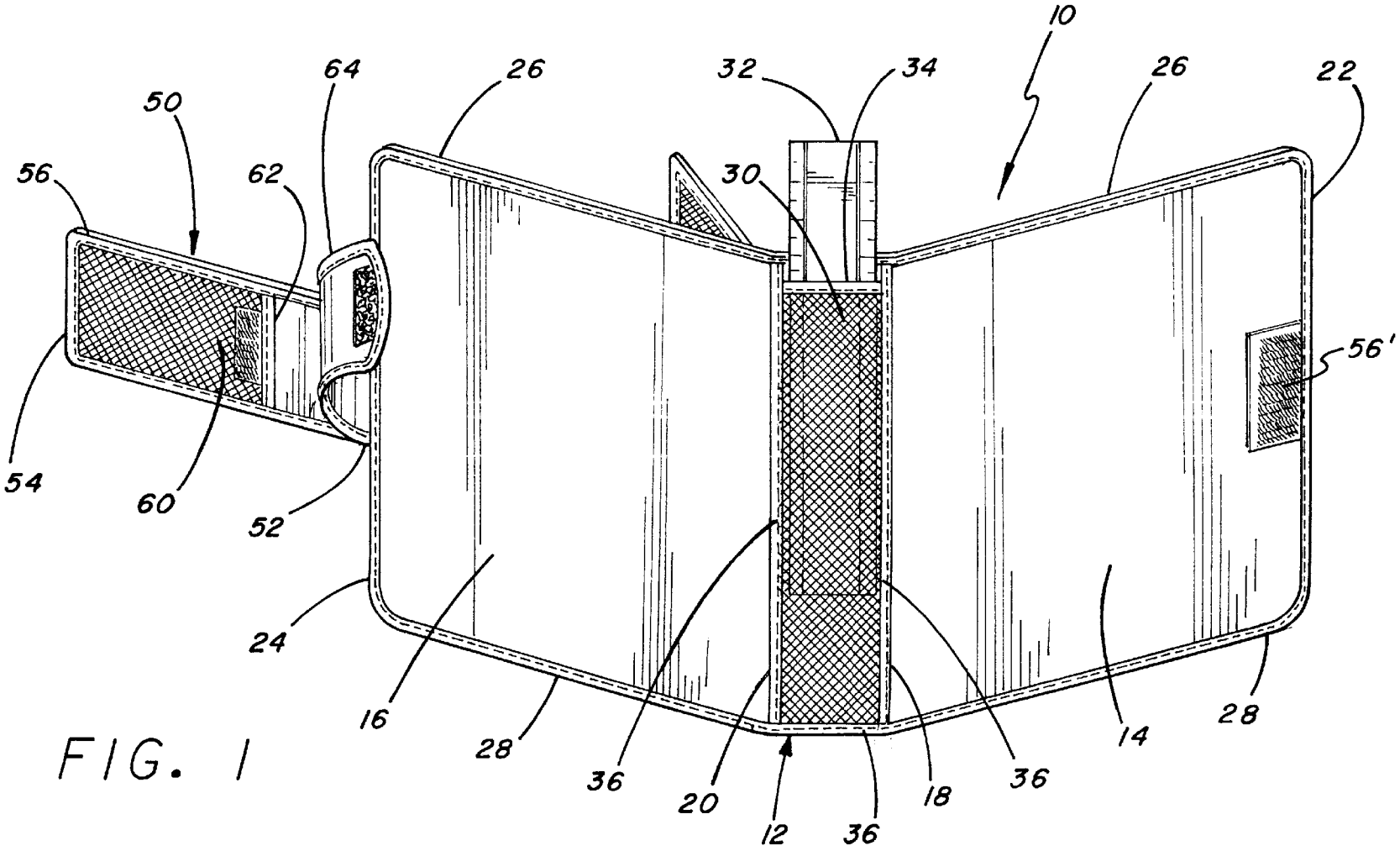
FIG. 1 is a perspective view of the exterior of an exemplary binder in an open position with exemplary mesh pockets associated with the exemplary binder.

As illustrated for example in FIG. 1, a binder 10 is shown, which is constructed to hold standard size sheets of 8½ by 11 inches, or A-4 size paper. The binder 10 includes a spine 12, a front cover 14, and a back cover 16 connected to the opposite edges of the spine 12, along fold lines 18 and 20, respectively. The front and back covers and the spine define the outer edges of the binder 10, i.e., a front edge 22, back edge 24, top edge 26, and bottom edge 28. The front and back covers 14,16 have a preferred width of about eleven inches and height of about thirteen inches. The binder 10 may also be sized to accommodate paper sheets larger or smaller than 8½ by 11 inches. For example, typical carry-type organizers and calendars are usually about 5 inches by 7 inches, while binders for photo albums can be about 12 inches by 15 inches.

The front and back covers and the spine each has an inner base (not shown) to give the respective covers and the spine a body with the dimensions as discussed above. The respective inner bases provide structural support, yet they are somewhat flexible so that the covers are able to contour around the items being held with some resistance. The inner base is preferably made of suitable paper board or other suitable material. The respective inner bases are also enclosed by a suitable material that is known to one who is ordinarily skilled in the art to form an outer covering; preferably a fabric, nylon or plastic sheet material is used to enclosed the inner bases. Still further, a thin foam layer (not shown) may be provided between the inner base and the enclosed fabric to give the binder a softer feel.

Figure 2A:
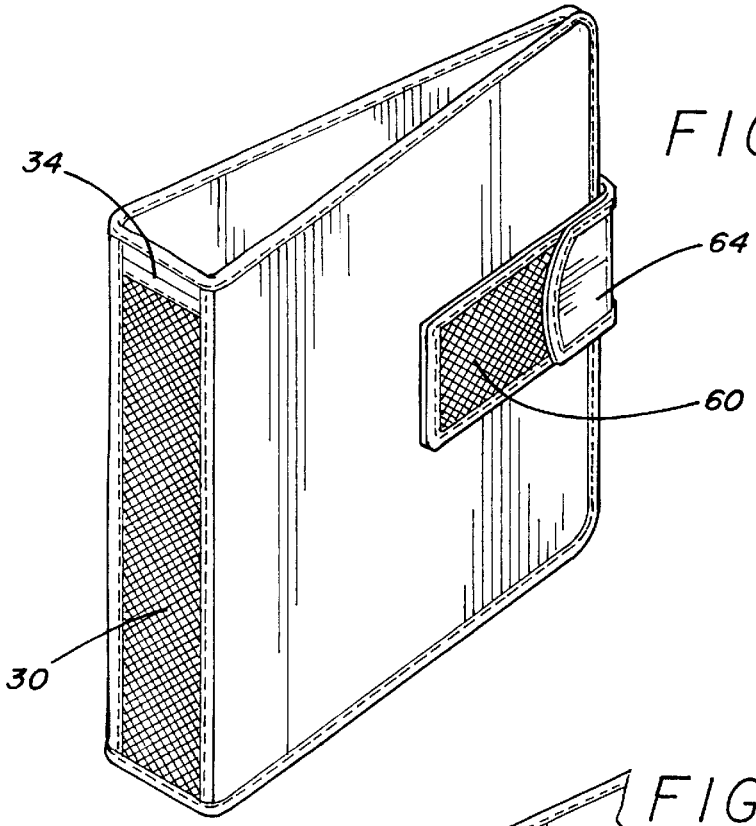
FIG. 2A is a perspective view of an exemplary binder in a closed position with exemplary mesh pockets associated with the binder.
Figure 2B:
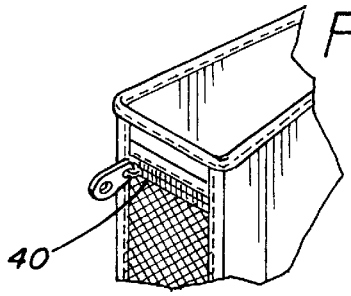
FIG. 2B is a perspective view of an upper portion of the binder shown in FIG. 2A, with the addition of an exemplary zipper to open and close a mesh pocket associated with a spine of the exemplary binder.
Figure 2C:
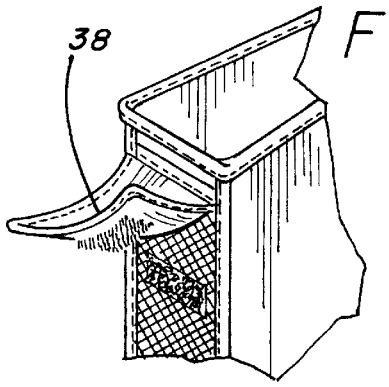
FIG. 2C is a perspective view of an upper portion of the binder of FIG. 2A, with an additional flap to close the mesh pocket associated with a spine of the binder.

As illustrated by way of example in FIGS. 1 through 2C, the binder 10 has at least one mesh pocket on the exposed side of the binder. The mesh pocket or pockets adds additional carrying capacity to the binder and allows a user to visually check quickly to determine if a particular item is being carried by the binder, rather than opening the binder to check. In particular, a pocket 30 substantially covers the spine 12 of the binder 10, and is coupled to the spine 12 along three of the four edges, with an opening along one of the edges. Preferably, the pocket 30 is coupled to the spine 12 along the fold lines 18 and 20, and bottom edge 28 between the fold lines 18 and 20, leaving an opening 34 along the top edge 26 between the fold lines 18 and 20. The pocket 30 is preferably flexible and resilient so that items such as an exemplary ruler 32 may be easily inserted through the opening 34 and held within the pocket, and conversely easily taken out of the pocket through the opening 34. Alternatively, the pocket 30 may be coupled to the outer surface of the binder covers along any position or angle. That is, the placement of the pocket 30 is not limited to the spine as illustrated in FIGS. 1–2C.

FIGS. 1 through 2C also illustrate by way of example a flap 50 with a first end 52 and a second end 54. The first end is coupled to the edge of the back cover 16 and the second end is adapted to releasably couple to the edge of the front cover 14. Once the covers are closed, the flap may be releasably coupled to the front cover to securely hold the covers closed. Preferably, the flap 50 releasably couples to the front cover of the binder by a VELCRO hook and loop system 56 and 56'. More specifically, the mating side of the flap 50 and the mating edge on the front binder are adapted with the VELCRO hook and loop system 56 and 56' to releasably couple to each other. FIG. 2A illustrates best the VELCRO system securely holding the binder in the closed position.

Furthermore, a second pocket 60 substantially covers the flap 50, and is coupled to the flap 50 along three of the four edges, with an opening along one of the edges. Preferably, the second pocket has an opening 62 with a closure mechanism 64 coupled adjacent to the opening 62. Preferably, the second pocket 50 is flexible and resilient so that items such as a credit card or key chain may be easily inserted through the opening 62 and held within the second pocket, and conversely easily taken out of the second pocket through the opening 62. To securely hold the items within the second pocket 60, the closure mechanism 64 is preferably adapted with a VELCRO hook and loop system to releasably seal the opening 62. Alternatively, a zipper mechanism (not shown) may be coupled to the opening to open and close the opening 62.

As another alternative, the opening 62 and closure mechanism 64 may be near the edge 54 rather than the edge 52.

Figure 3C:
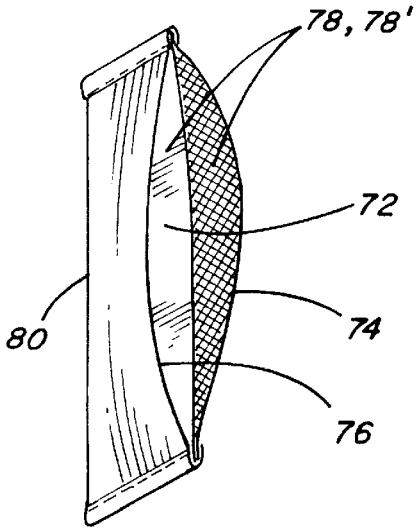
FIG. 3C is a perspective view of the pocket illustrated in FIGS. 3A and 3B, showing the double pocket configuration of the pocket.
Figure 3A:
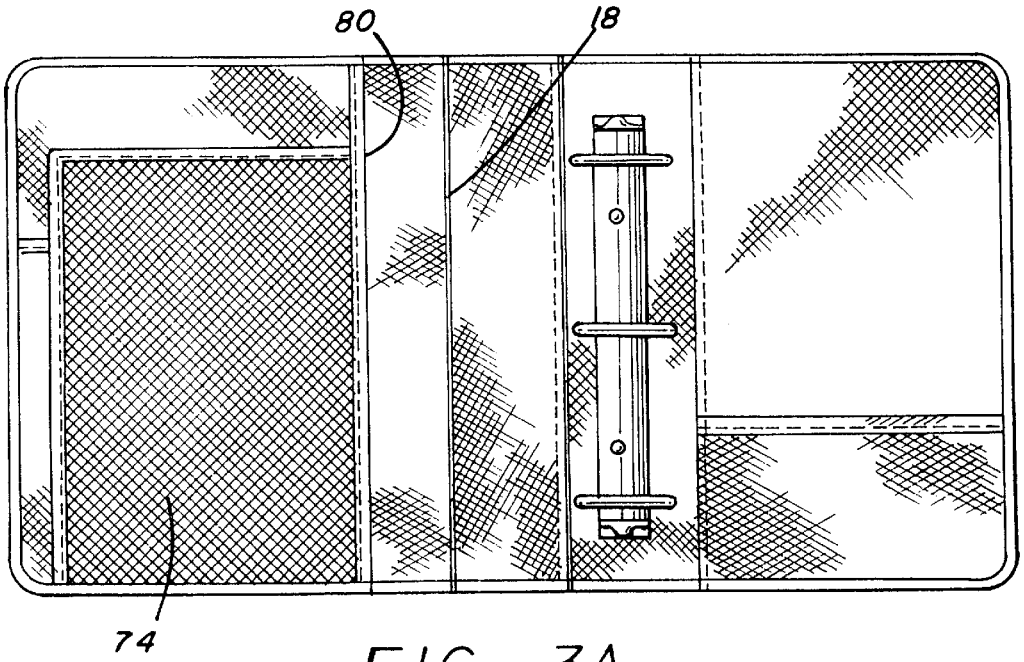
FIG. 3A is a view of an exemplary binder in an open position illustrating the positioning of a pocket in a location spaced outward from the ring mechanism of the binder.
Figure 3B:
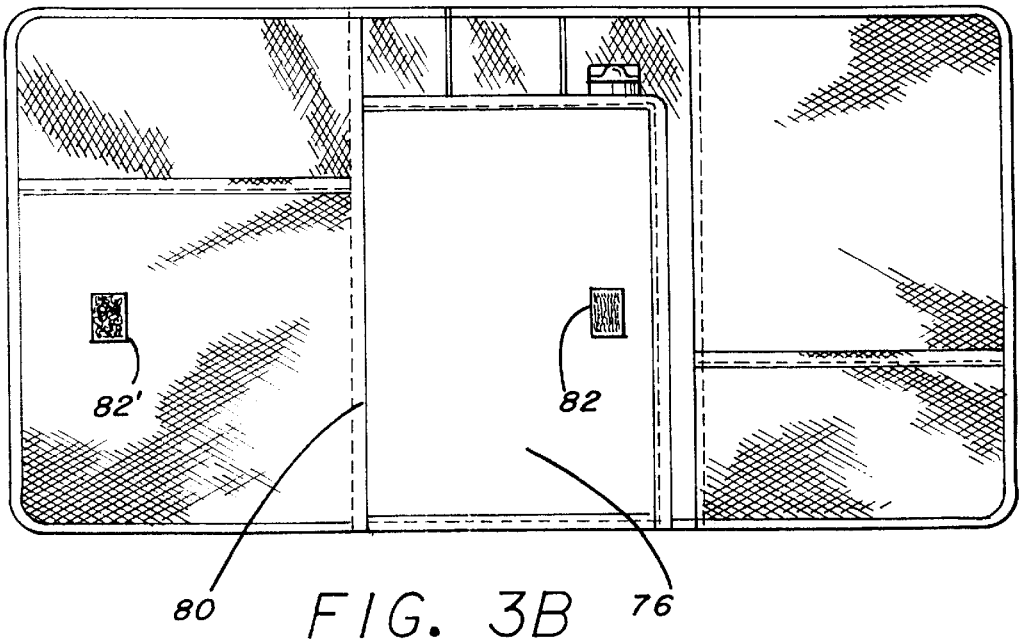
FIG. 3B is a view of an exemplary binder in an open position illustrating the pocket shown in FIG. 3A rotated toward the ring mechanism of the binder.

FIGS. 3A through 3C illustrate by way of example still another embodiment of the present invention, showing a pocket assembly including a pair of pockets 74 and 76 coupled to the inside of one of the binder covers. The pocket assembly 74, 76 is divided by a divider 72 forming the pockets 74 and 76. With the ruler pocket 30 and the second (closure) pocket 60, the pocket assembly 74, 76 constitutes a third mesh pocket in the binder assembly; and with the divider 72, this assembly provides third and fourth pockets. The divider, third and fourth pockets are coupled along three of the four edges, leaving openings 78 and 78' on one of the edges, as illustrated most clearly in FIG. 3C. Preferably, one of the coupled edges of the pair of pockets is coupled to the inside of the binder cover. As illustrated in FIG. 3A, the opposite edge 80 relative to the openings is preferably coupled to the inside of the front cover approximately 1 to 4 inches left from the fold line 18 so that as the front cover is closed the pair of pockets 74, 76 are juxtaposed to the papers held by the three ring mechanism and not over the three ring mechanism. As such, the pockets 74 and 76 may bulge out as they are filled because only the edge 80 is coupled to the front cover so that other three edges are not restricted from expanding outwardly. Accordingly, the pockets may be overstuffed so that the void left between the front cover and the papers in the three ring mechanism when the binder is closed can be fully utilized by the overstuffed pockets. Alternatively, the pockets 74, 76 may be coupled to the front or back covers. Also, the pair of pockets may be coupled to the cover along any of the edges and have an opening along any of the edges.

Preferably, the third pocket 74 is made of mesh material so that a user can see the items being held within the third pocket 74. Additionally, the divider and the fourth pocket are preferably made of non-transparent materials so that personal or embarrassing items may be secretly stored in the fourth pocket 76. For example, as illustrated in FIG. 3A, when the third pocket is facing the user, the fourth pocket is not noticeable, so that a non-user is not even aware of the fourth pocket, and thus a user may more securely place sensitive items in the fourth pocket with some assurance that these items will not be discovered. Furthermore, to hold the pockets 74, 76 in place as shown in FIG. 3A, preferably a VELCRO hook and loop system 82, 82' is adapted to the back side of the fourth pocket, as illustrated by way of example in FIG. 3B. Also, the openings 78, 78' may be provided with a closure mechanism such as a VELCRO system or a zipper mechanism to securely hold the items in the pockets.

With regard to material, the pockets should be flexible and may be of resilient or expandable material to contour around the shapes of the items being held, yet the material should be elastic enough to return to its original shape once the items are removed. Furthermore, the material may be transparent or opaque so that a user can see whether a particular item is within the pocket. Further, the pockets are preferably treated with UV coating to protect against harmful effects of the ultra violet rays from the sun. In this regard, the pockets may be made of fabric, polyester, and polyvinyl chloride, with Nylon being the preferred material, or they may be made from other materials exhibiting the qualities discussed above that are known to one ordinarily skilled in the art. Still further, the pockets should preferably be mesh pockets or made of net pattern so that they are transparent, so that a user will know whether a particular item of importance is carried by the binder or not.

To have an aesthetically pleasing appearance, for example, the pocket 30 may be coupled to the spine along the fold lines 18 and 20, and the bottom edge 28 between the fold lines 18 and 20. Preferably a liner (thin strip) 36 is used to contour around where the pocket is coupled to the spine and is sewn together, to provide a smooth high quality finish around the edges of the pocket. Likewise, the same high quality finish may be provided to other pockets.

FIG. 2C illustrates by way of example another embodiment of the present invention, showing a closure mechanism 38 that is coupled adjacent to the opening 34. In this embodiment the closure mechanism is attached along the top edge of the spine 12. The flap 38 is releasably coupled to the spine in the closed position to securely hold the item held within the pocket 30, such as a ruler. Preferably, the closure mechanism 38 only opens when a user intentionally opens the flap. In this regard, the flap 38 in the closed position is preferably coupled to the spine via a VELCRO hook and loop system.

FIG. 2B illustrates by way of example yet another embodiment of the present invention, showing a zipper 40 coupled to the opening 34 to open and close the pocket. In this embodiment the zipper 40 is coupled along the top edge of the spine 12.

Although the present invention has been described in terms of the preferred embodiments above, numerous modifications or additions to the above-described preferred embodiments would be readily apparent to one skilled in the art. Thus, by way of example and not of limitation, the opening 34 may be along the fold lines 18 or 20. The material for the pocket may also be non-transparent. Also, the pocket 30 may be formed along a variety of binders such as a typical carry-type organizers which are usually about five inches by seven inches, while binders for photo albums can be about twelve inches by fifteen inches. Lastly, it is within the scope of the present invention to have any combination of the pockets disclosed here in the application coupled to a binder. For example, only one of the pockets such as the first, second, third, or fourth pocket may be coupled to a binder; or any combination thereof, such as the first and second pockets but not the third or fourth. Accordingly, the present invention is not limited to the specific embodiments illustrated and described hereinabove. With respect to the claims, it is applicant's intention that the claims not be interpreted in accordance with the sixth paragraph of 35 U.S.C. § 112 unless the term "means" is used followed by a functional statement.

What is claimed is:

1. A binder with a mesh pocket on the exterior surface of a binder, comprising:

a front cover;

a back cover;

a spine coupling the front and back cover along a front fold line and a back fold line, respectively, forming a binder;

wherein the binder gas an exterior surface when the binder is in a closed position; and a flexible mesh pocket coupled to the exterior surface of the binder, wherein the flexible mesh pocket has outer edges substantially coextensive with the spine, wherein the outer edges are coupled to the spine along the outer edges of the flexible mesh pocket, except on one edge to form an opening;

a flap having opposite ends, wherein the one end of the flap is coupled to the edge of the back cover and the opposite end of the flap is adapted to releasably couple to the edge of the front cover, to securely close the binder in the closed position; and a second mesh pocket having outer edges substantially coextensive with the flap, wherein the outer edges of the second mesh pocket are couple to the flap along the outer edges of the second mesh pocket, except on one edge to form an opening.

2. A binder according to claim 1, wherein the mesh pocket has elongated substantially rectangular outer edges extending substantially along the height of the binder, wherein the mesh pocket is coupled to the front cover along the outer edges of the mesh pocket, except on one edge to form an opening.

3. A binder according to claim 1, wherein the mesh pocket has elongated substantially rectangular outer edges extending substantially along the height of the binder, wherein the mesh pocket is coupled to the back cover along the outer edges of the mesh pocket, except on one edge to form an opening.

4. A binder according to claim 1, including a cover coupled to the flap adjacent to the opening of the second mesh pocket, wherein the cover is adapted to releasably couple to the second mesh pocket to secure the items held within the second mesh pocket.

5. A binder with a plurality of mesh pockets, comprising:

a front cover;

a back cover;

a spine coupling the front and back covers along a front fold line and a back fold line, respectively, forming a binder;

a plurality of mesh pockets coupled to the binder; and a flap having opposite ends, wherein the one end of the flap is coupled to the edge of the back cover and the opposite end of the flap is adapted to releasably couple to the edge of the front cover, to securely close the binder in the closed position; wherein one of the plurality of mesh pockets has outer edges substantially coextensive with the flap, wherein the outer edges of the mesh pocket, are coupled to the flap along the outer edges of the mesh pocket except on one edge to form an opening.

6. A binder according to claim 5, wherein the plurality of mesh pockets are made of nylon.

7. A binder according to claim 5, wherein one of the plurality of mesh pockets has outer edges substantially coextensive with the spine, wherein the outer edges are coupled to the spine along the outer edges the mesh pocket, except on one edge to form an opening.

8. A binder according to claim 5 wherein the binder has an interior surface when the binder is in a open position, wherein one of the plurality of mesh pockets has outer edges, wherein one of the outer edges is coupled to the interior surface of the binder.

9. A binder according to claim 8, including a three ring mechanism associated with the back cover and running substantially parallel with the back fold line, wherein the outer edge of the mesh pocket that is closest to the three ring mechanism is at least one inch away from the three ring mechanism.

10. A binder according to claim 8, wherein one of the outer edges that is coupled to the interior surface of the binder runs parallel to the front fold line.

11. A binder according to claim 10, wherein one of the outer edges that is coupled to the interior surface of the binder is closest to the front fold line.

12. A binder according to claim 8, wherein one of the plurality of mesh pockets has a pair of pockets juxtaposed to each other, wherein one of the pair of pockets is a mesh pocket and the other pair of pockets is a non-transparent pocket divided by a divider.

13. A binder according to claim 12, wherein the non-transparent pocket is juxtaposed to the interior surface of the binder when the binder is in a closed position.

14. A binder with a mesh pocket on the exterior surface of a binder, comprising:

a front cover;

a back cover;

a spine coupling the front and back covers along a front fold line and a back fold line, respectively, forming a binder;

wherein the binder has an exterior surface when the binder is in a closed position;

a mesh pocket coupled to the exterior surface of the binder;

a flap having opposite ends, wherein the one end of the flap is coupled to the edge of the back cover and the opposite end of the flap is adapted to releasably couple to the edge of the front cover, to securely close the binder in the closed position; and a second mesh pocket having outer edges substantially coextensive with the flap, wherein the outer edges of the second mesh pocket are coupled to the flap along the outer edges of the second mesh pocket, except on one edge to form an opening.

15. A binder according to claim 1, including a cover coupled to the flap adjacent to the opening of the second mesh pocket, wherein the cover is adapted to releasably couple to the second mesh pocket to secure the items held within the second mesh pocket.

* * * * *